US008231945B1

(12) United States Patent
Gintz et al.

(10) Patent No.: US 8,231,945 B1
(45) Date of Patent: Jul. 31, 2012

(54) METHOD FOR IMPACT DEFLECTING MATERIALS

(75) Inventors: Graham E. Gintz, Hilton Head Island, SC (US); Christopher J Gintz, Hilton Head Island, SC (US); Timothy J. Imholt, Carrollton, TX (US); David L. Allara, State College, PA (US)

(73) Assignee: Intelligent Textiles, Inc., Hiltonhead, SC (US)

( * ) Notice: Subject to any disclaimer, the term of this patent is extended or adjusted under 35 U.S.C. 154(b) by 1367 days.

(21) Appl. No.: 11/888,165

(22) Filed: Jul. 31, 2007

Related U.S. Application Data

(62) Division of application No. 11/050,884, filed on Feb. 4, 2005, now Pat. No. 7,682,694.

(51) Int. Cl.
*D02G 3/00* (2006.01)

(52) U.S. Cl. ..... 427/487; 427/598; 977/734; 977/742; 977/750; 977/753; 977/778

(58) Field of Classification Search ..... 428/364, 428/401; 977/734, 742, 750, 753, 778; 427/487, 427/598

See application file for complete search history.

(56) References Cited

U.S. PATENT DOCUMENTS

| | | | |
|---|---|---|---|
| 4,969,386 | A | 11/1990 | Sandstrom et al. |
| 5,097,538 | A | 3/1992 | Feuling |
| 7,105,596 | B2 | 9/2006 | Smalley et al. |
| 2002/0085968 | A1 | 7/2002 | Smalley et al. |
| 2005/0074390 | A1 | 4/2005 | Tour et al. |
| 2005/0169830 | A1 | 8/2005 | Richard et al. |
| 2005/0245667 | A1 | 11/2005 | Harmon et al. |

*Primary Examiner* — Matthew Matzek

(74) *Attorney, Agent, or Firm* — Robert W Strozier; Jerry Lester

(57) ABSTRACT

Method for making a low cost, light weight impact deflecting material, comprising directionally aligned single walled carbon nanotubes in an epoxy resin composition, that is near impervious to bullets fired at close range at all angles of incidence, that does not deteriorate upon abrasion or when exposed to wide ranges of temperature and humidity, and that when used to construct a protective shield for a body armor vest protects the wearer from blunt trauma effects.

2 Claims, 7 Drawing Sheets

METHOD FOR IMPACT DEFLECTING MATERIALS

CROSS REFERENCE TO RELATED APPLICATIONS

This Application is a Divisional Application of application Ser. No. 11/050,884, now U.S. Pat. No. 7,682,694 filed on Feb. 4, 2005, for "Product And Method For Impact Deflecting Materials", to which a claim of priority to Feb. 4, 2005 is made.

FIELD OF THE INVENTION

The invention relates generally to the production of impact deflecting materials, and more specifically to a method for producing materials that improve the capability to resist impact and deflect bullets discharged by a firearm.

BACKGROUND OF THE INVENTION

Numerous fabrics, materials, composites, structures, and assemblies are known for use in bullet proof vests including those disclosed in U.S. Pat. Nos. 5,776,838; 5,614,305; 5,090,053; 4,822,657; and 4,510,200. However, none are known which exhibit the combined light weight, resistance to impact and perforation damage, tolerance to wide variations in temperature and humidity, and low manufacturing costs offered by the impact deflecting material of the present invention.

Bullet proof vests which are made of Kevlar are known. Kevlar is a synthetic aramid fiber which when assembled in layered fabric form or laminated with other materials provides high impact resistance, high strength to weight ratio, high tensile modulus, RF transparency, thermal stability, fire resistance, corrosion resistance, and durability. However, such vests are expensive to manufacture, are a heavy burden (generally 9 to 18 pounds) to the wearer, and provide inadequate protection against blunt trauma effects such as broken ribs and body bruises. Further, Kevlar type woven fabrics are susceptible to deterioration due to abrasion, moisture, or sunlight, and must be encased in moisture-proof and light-proof coverings.

SUMMARY OF THE INVENTION

It is an object of this invention to produce a low cost, lightweight product having improved projectile deflection characteristics at all angles of incidence, as well as improved resistance to impact and perforation damage.

It is an additional object of this invention to provide a product to repel, resist, and deflect high velocity projectiles without injury to a person wearing a garment comprised of the product.

It is a further object of the invention to provide a product that does not deteriorate appreciably from abrasion, and that when fully exposed to inclement weather tolerates a wide range of temperature and humidity without deterioration or chemical breakdown.

In one aspect of the invention, the product is formed from a mixture comprising single-walled carbon nanotubes (SWCNT's) in an epoxy resin composition that is cured in a temperature and humidity controlled environment in the presence of an electric field having a near electric field strength sufficient to align the SWCNTs in a same direction.

In another aspect of the invention, an impact deflecting material is produced that is of a light weight and low cost, that has improved projectile deflection characteristics at all angles of incidence, that exhibits improved impact puncture and perforation resistance characteristics, that provides improved protection against blunt trauma effects, that tolerates without deterioration wide ranges of temperature and humidity when fully exposed to inclement weather, and that does not appreciably deteriorate from abrasion.

BRIEF DESCRIPTION OF THE DRAWINGS

The foregoing and other objects, aspects, and advantages of the invention will be better understood from the following detailed description of the preferred embodiments of the invention when taken with reference to the drawings, in which.

DETAILED DESCRIPTION OF PREFERRED EMBODIMENTS

The following definitions are used consistently throughout this specification:

"SWCNT(s)" means single walled carbon nanotubes.

The words "ascertainable", "appreciable", and "discernible" as used in this specification mean to discover or detect by the naked eye or through the aid of a device such as a magnifying glass.

Figure 1:
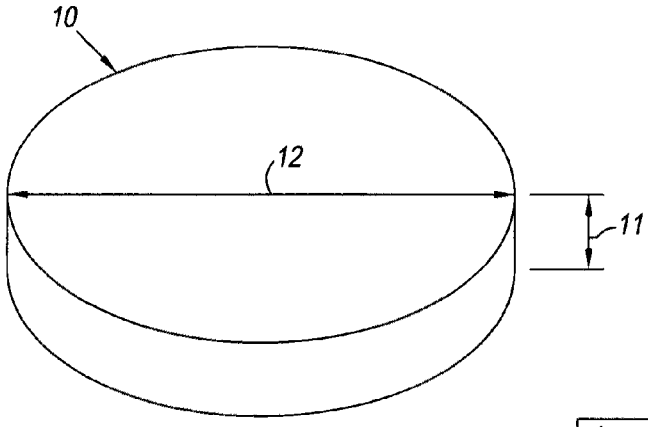
FIG. 1 is a perspective view of a circular brick of impact deflecting material prepared in accordance with the present invention.

Referring to FIG. 1, a circular brick 10 of impact deflecting material, in accordance with the invention, is illustrated which is approximately 6 millimeters in height 11, and 86 millimeters in diameter 12.

In manufacturing the impact deflection bricks of FIG. 1, an environment having a temperature range of 65 to 72° F., a relative humidity of 30-50%, and a near DC electrical field strength of 0.0428557 volts/meter is prepared. In that environment, a mixture having the following ingredients by percentage weight with not-less-than to not-more-than ranges as set out in Table I below is prepared:

TABLE I

| Percentage By Weight | Ingredient |
|---|---|
| 1 | SWCNT Mixture |
| 27.5-35 | Calcium Carbonate |
| 5.0-10.0 | Iron Powder |
| 10.0-15.0 | Epoxy Resin |
| 1.0-5.0 | Amorphous Silica |
| 7.5-12.5 | Non-Fibrous Talc |
| 0.5-2.5 | Aromatic Hydrocarbons |
| 17.5-22.5 | Barium Sulfate |
| 0.5-2.5 | Alkyl Phenol |
| 10.0-15.0 | Mercaptan Terminated Polymer |
| 0.5-2.5 | [2,4,6 Dimethylamino Methyl] Phenol 1 |

A mixture of impact deflecting material in accordance with the invention is comprised of each ingredient listed in Table I above, with each ingredient being within its respective weight percentage range, and with the total weight percentage of all ingredients being 100%.

In the preferred embodiment, the mixture is comprised by percentage weight of the following ingredients: 1% SWCNTs, 32% Calcium Carbonate, 5% Iron powder, 15% Epoxy Resin, 1% Amorphous Silica, 8% Non-Fibrous Talc, 0.5% Aromatic Hydrocarbons, 17.5% Barium Sulfate, 2.5% Alkyl Phenol, 15% Mercaptan Terminated Polymer, and 2.5% [2,4,6 Dimethylamino Methyl]Phenol 1.

The specifications for each of the above ingredients are as presented in Table II below:

TABLE II

Mixture Ingredient Specifications

| PRODUCT | COMMERCIAL ID/PART NUMBER | PURITY/ GRANULARITY | MANUFACTURER | ADDRESS |
|---|---|---|---|---|
| SWCNTs | C4 AP Grade | 50 to 70% | Carbolex, Inc. | 234 McCarty Court; Lexington, Kentucky 40508 |
| Metal Epoxy Resin | JB Kwik Part A | Dark smooth paste with a specific gravity of 1.83; no volatile organic compounds; with the following ingredients by percentage weight: Calcium Carbonate (50-60%), Iron Powder (5-10%), Epoxy Resin (20-30%), and Amorphous Silica (1-5%). | J B Weld | P.O. Box 483, Sulphur Springs, Texas 75483 |
| Metal Epoxy Hardener | JB Kwik Part B | White paste with a specific gravity of 1.87; volatile organic compounds P/G of .0334; volatile organic compounds G/L of 4.0026; with the following ingredients by percentage weight: Calcium Carbonate (5-10%), Non-Fibrous Talc (15-25%), Barium Sulfate (35-45%), Alkyl Phenol (1-5%), Mercaptan Terminated Polymer (20-30%), [2,4,6 Dimethylamino Methyl] Phenol 1(1-5%), and Amorphous Silica (1-5%). | J B Weld | P.O. Box 483, Sulphur Springs, Texas 75483 |

Figure 2:
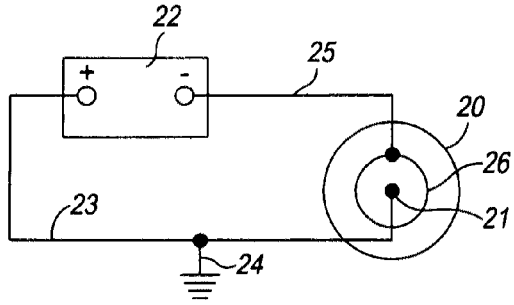
FIG. 2 is a functional block diagram of a system used to cure a mixture of impact deflecting material, in accordance with the invention, from which the circular bricks of FIG. 1 are formed.

FIG. 2 illustrates the system used in preparing and curing a mixture of impact deflecting material in accordance with the invention. The temperature and humidity within which the system resides is controlled to maintain the temperature within a range of 65 to 72° F., and the humidity within a range of 30 to 50%. More particularly, temperature is controlled by a standard wall thermostat. Temperature and humidity are measured with a Taylor Hygrometer, Model No. 5387, manufactured by Taylor Precision Product Company of Oak Brook, Ill. The humidity is controlled by increasing or decreasing the temperature within the preferred 65° to 72° F. temperature range.

An 86 millimeter in diameter Petri dish 20 has a 1 mm hole 21 in its center. A DC electric field having a near electrical field strength of 0.042857 volts/meter is created by attaching the positive terminal of a RAY-O-VAC 6 volt battery 22, by way of a 20 gauge copper wire 23, to an electrical ground 24 that is placed 112 centimeters from the positive terminal of the battery 22.

The RAY-O-VAC battery is a Heavy Duty 6 volt battery, stock number 944, which is generally available at hardware stores throughout the nation.

The electrical ground 24 is created by winding the copper wire 23 twenty-five times around a number SS-50 steel screw that is mounted to an iron vise. The copper wire further extends an additional 12 centimeters from the steel screw and downward through the 1 mm hole 21 at the center of the Petri dish. The hole 21 then is sealed by an adhesive tape such as standard scotch tape to keep SWCNTs from falling through the hole.

The negative terminal of the battery 22 is connected by way of a 20 gauge copper wire 25 to a mixture of impact deflecting material (in accordance with the invention) that is at a distance of ninety centimeters from the negative terminal. The distal end of the wire forms a 7 centimeter in diameter loop 26 that is aligned coaxially with the Petri dish 20, and lies on the upper surface of the dish. The DC electric field created by the battery 22, when connected as described above, serves to align the SWCNTS comprising the mixture of impact deflecting material during its cure period.

The mixture of impact deflecting material, comprising the ingredients listed in Table II in the weight percentages presented in Table I, is formed by first sprinkling the SWCNTs onto a fiber glass cloth placed in the Petri dish 20, and then uniformly covering the SWCNTs with a composition of the remaining ingredients of Table I. The mixture next is blended at 2800 rpm for about a minute with a generally available blending tool such as a Dremel 2850 rotary mixing tool manufactured by Dremel, a division of Robert Bosch Tool Corporation of Racine, Wis. The mixture thereafter is hand mixed for about a minute to achieve a uniformity in circular shape, color, and depth. The plastic lid normally accompanying Petri dishes is then placed over the Petri dish 20, and the mixture is allowed to cure for seven hours in the controlled environment and DC electric field.

During the cure period, the internal temperature of the mixture is periodically measured as depicted by the graphs of FIGS. 3-7. The graphs show the occurrence of a number of reactions until the mixture reaches stability at one hundred fifteen minutes after the mixing process is completed. This phenomenon further is illustrated in Table III below where the external temperature of battery 22 is compared with the internal temperature of the mixture during the first one hundred twenty minutes of the cure period. The potential difference between the positive and negative terminals of the battery 22 during the first one hundred twenty minutes also is shown. Over the entire seven hour cure period, the 6 volt battery was monitored, and was found to discharge approximately 90% during the full cure period.

TABLE III

| Elapsed Time (Minutes) | Battery Voltage (Volts) | External Battery Temperature ° C. | Internal Mixture Temperature ° C. |
|---|---|---|---|
| 0.00 | 6.62 | 70 | 25.2 |
| 0.00-1.00 | — | 95 | 25.2-24.8 |
| 1.00-3.00 | — | 95 | 24.8-27.3 |
| 3.00-5.00 | 5.96 | 95 | 27.3-25.3 |
| 5.00-12.00 | 5.76 | 100 | 25.3-48.4 |
| 12.00-44.00 | 5.69 | 100 | 48.4-25.3 |
| 44.00-82.00 | 5.66 | 110 | 25.3-(−118) |
| 82.00-96.00 | 5.58 | 105 | (−118)-25.3 |
| 96.00-120.00 | 5.55 | 101 | 25.2 |

The surface temperature of the mixture was measured with a Pacific Transducer, Model 572F, manufactured by Pacific Transducer Corporation of Los Angeles, Calif., and generally available at specialty metal working stores throughout the nation. The internal temperature of the mixture was measured with a Fluke Model 52K/J Thermometer with thermocouple, manufactured by John Fluke Manufacturing Company of Palatine, Ill., and generally available at thermal specialty instrumentation stores throughout the nation.

Figure 8A:
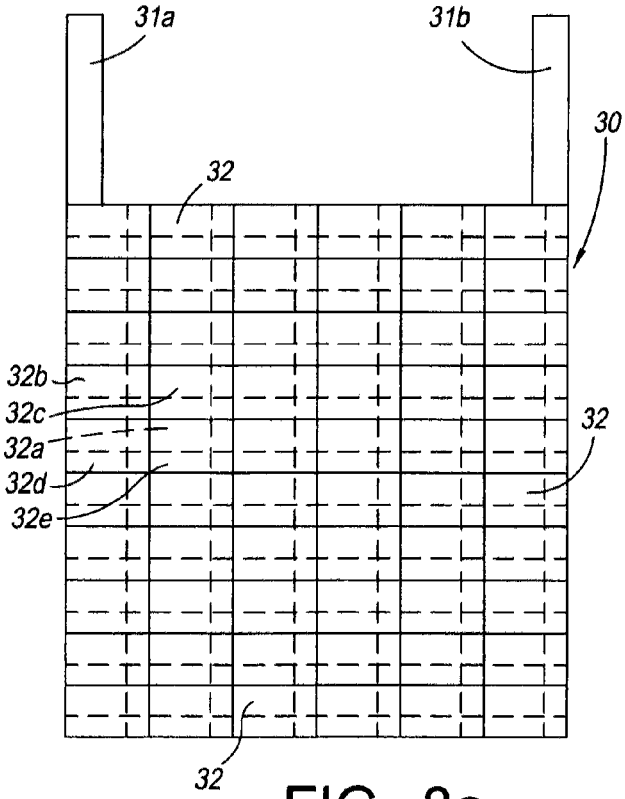
FIG. 8*a* is a front plan view of a vest with overlapping panels of impact deflecting material prepared in accordance with the invention and affixed to the vest.

Referring to FIG. 8*a*, a body armor, pull-over vest 30 with shoulder straps 31*a* and 31*b* is shown. The body of the vest 30 includes two layers of panels 32 of impact deflecting material prepared in accordance with the process of the present invention. In this embodiment, the circular bricks of FIG. 1 are trimmed into rectangular shapes. Each panel has a surface area of 921 square mm, and is 6.35 mm thick. While length and width of the panels has not been found to be critical to the results of actual tests which were conducted, best results occurred when the thickness of the panels either singularly or in layers was at least 12.7 mm. The weight of each panel including the fiber glass backing is 53.3 grams. As measured with a type C durometer calibrated in accordance with ASTM D-2240 standards, the average hardness of the panels was found to be 69.

It is to be understood that the circular bricks 10 of FIG. 1 may be trimmed into any shape, and that the impact deflecting material of the present invention may be cured into any shape by changing the shape of the structure on which the fiber glass backing is laid, and a mixture of the impact deflecting material thereafter is placed for curing. The resulting cured bricks of impact deflecting material thereby may be made to conform to any desired curvilinear shape.

In each of the two layers of panels 32 of FIG. 8*a*, the panels are arranged in a grid pattern of horizontal rows circumnavigating the wearer's body. The outer layer of the panels 32, as indicated by solid lines in FIGS. 8*a* and 8*b*, overlaps the inner layer of panels 32, as indicated by dotted lines, so that the boundaries between contiguous panels in rows and columns of the inner layer are overlapped by panels of the outer layer. By way of example, panel 32*a* of the inner layer of panels 32 is overlapped by panels 32*b*, 32*c*, 32*d*, and 32*e* of the outer layer of panels in such a manner that each boundary of panel 32*a* is covered by two panels of the outer layer to substantially reduce the possibility of penetration at the panel edges.

It also is to be understood that bricks of impact deflecting material in accordance with the invention may be trimmed after curing in such a manner that the SWCNTs in the inner layer of panels 32 are aligned in a direction different from the direction of alignment of the SWCNTs in the outer layer of panels 32. The overlapping of the inner and outer layers of panels 32 thereby provides a near impervious protective shield.

The panels 32 are held in place on the vest 30 by sewing with nylon thread to attach the fiber glass backing of the individual panels 32 to an inner layer of light weight fiber glass cloth comprising the vest. In the preferred embodiment, the vest 30 is made of nylon, and the light weight fiber glass cloth used in the inner layer of the vest is offered commercially by Bondo Corporation of Atlanta, Ga., as part number 20128.

Figure 8B:
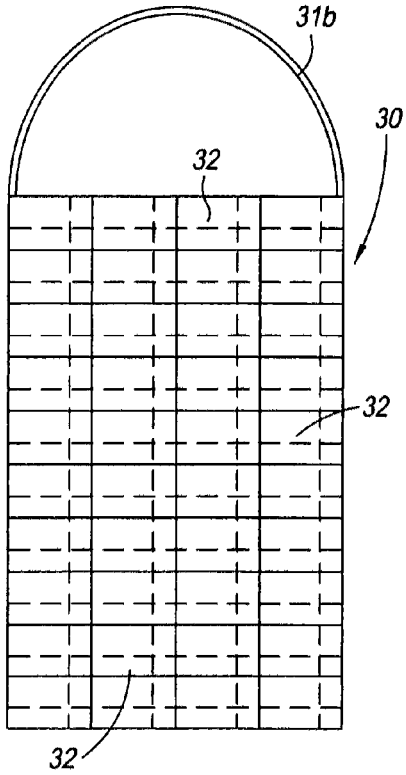
FIG. 8*b* is a left side view of the vest of FIG. 8*a*.
Figure 3:
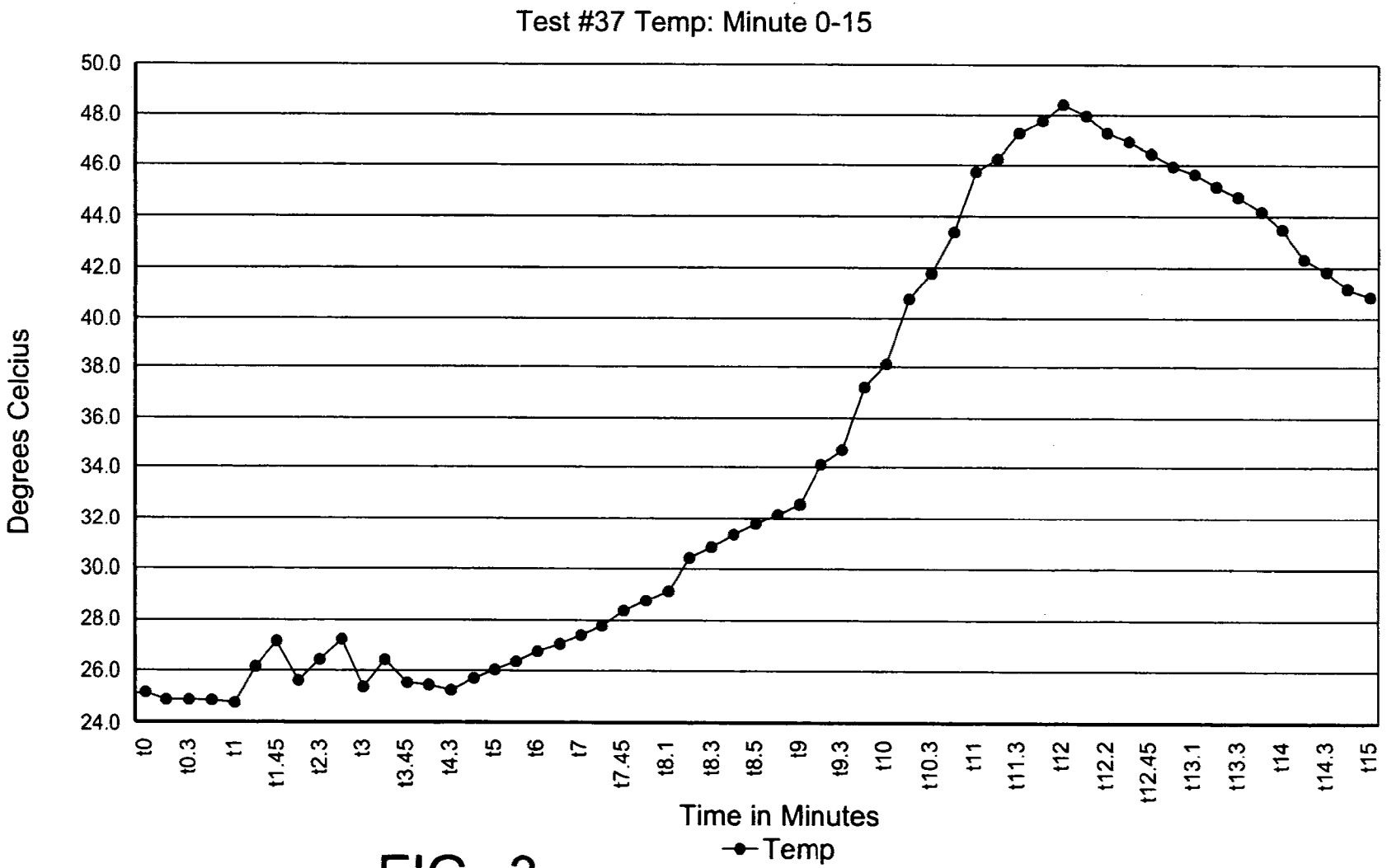
FIGS. 3-7 are graphs of the internal temperature of the mixture in accordance with the invention as taken during the cure period.
Figure 4:
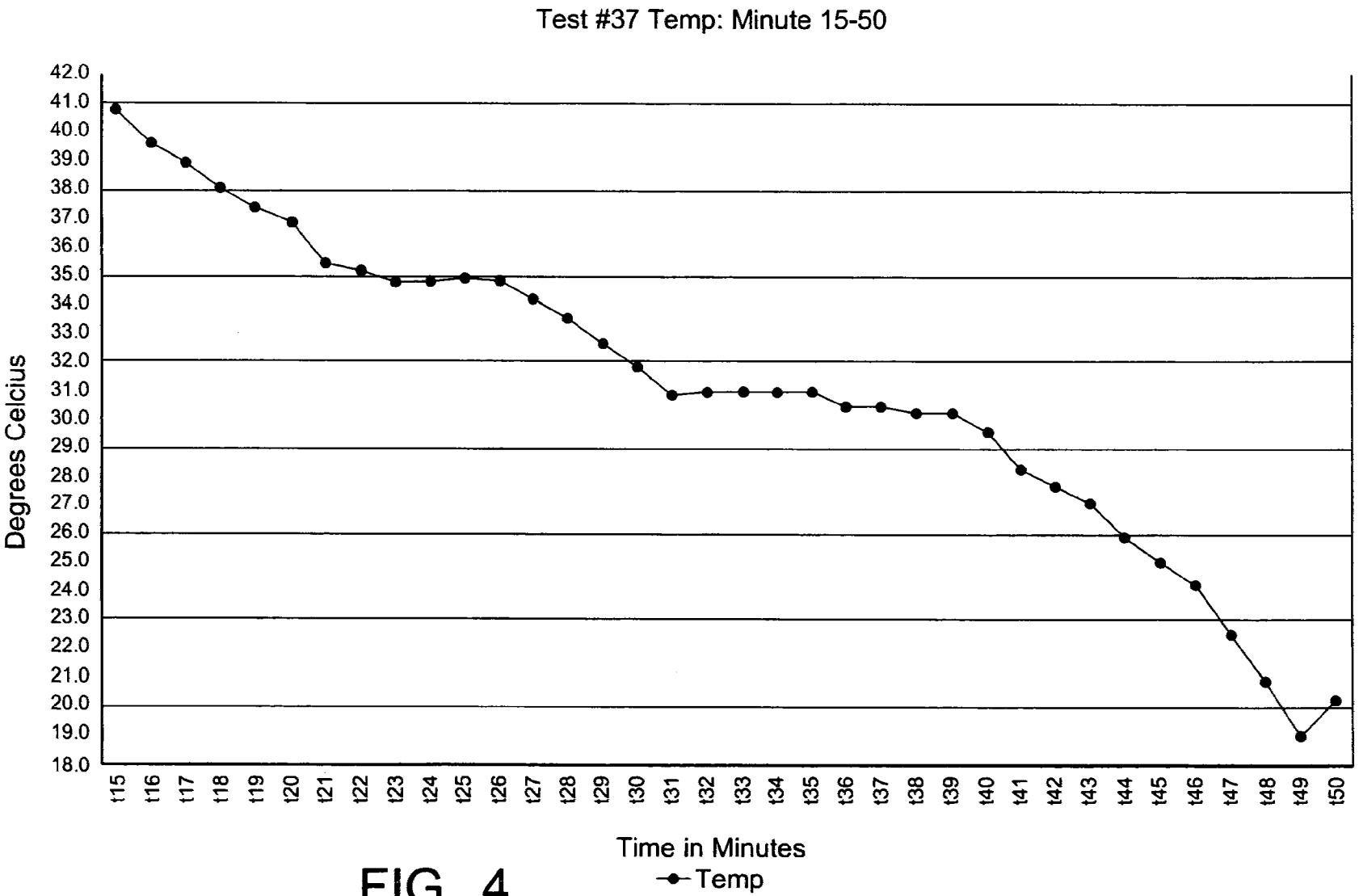
Figure 5:
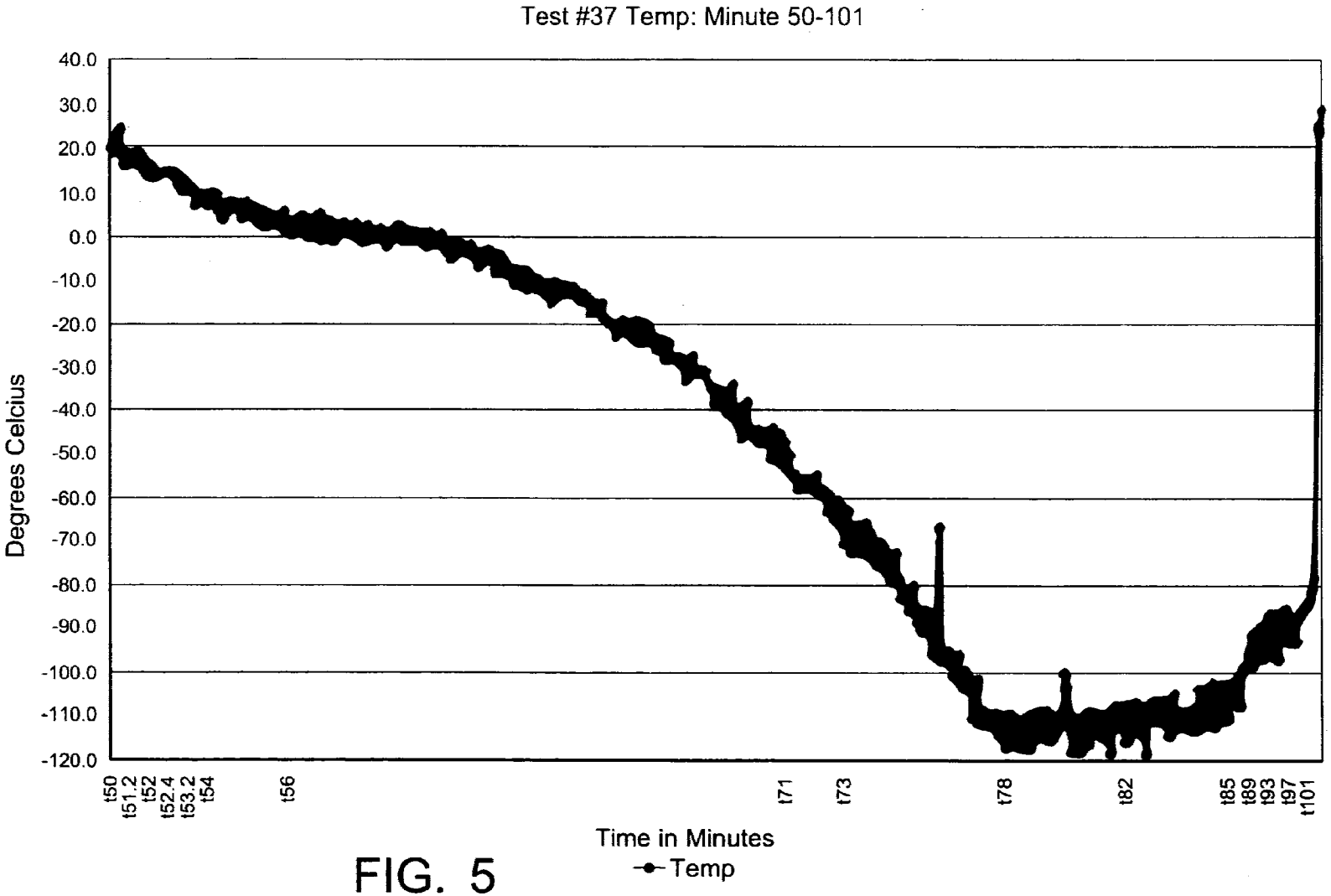
Figure 6:
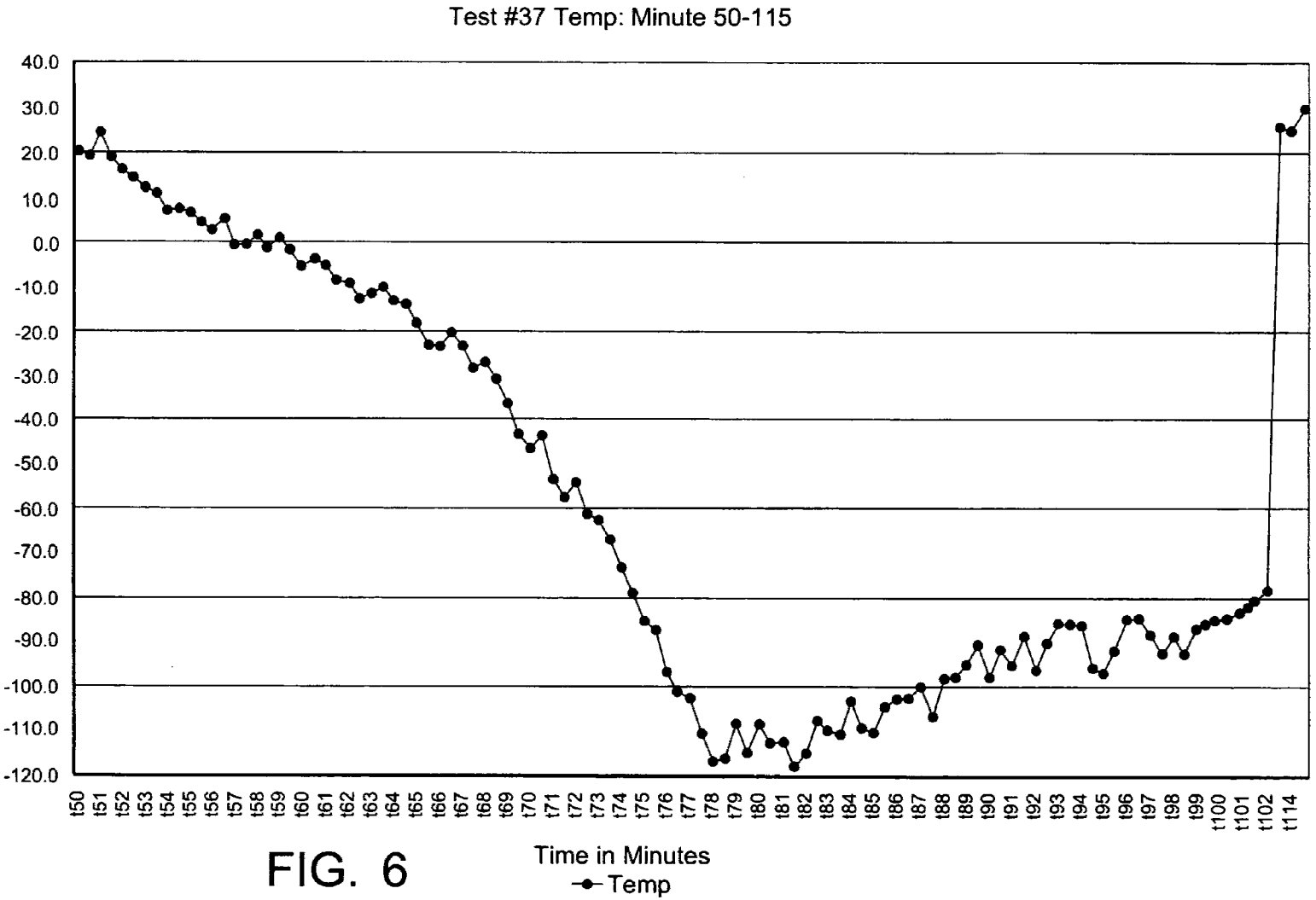
Figure 7:
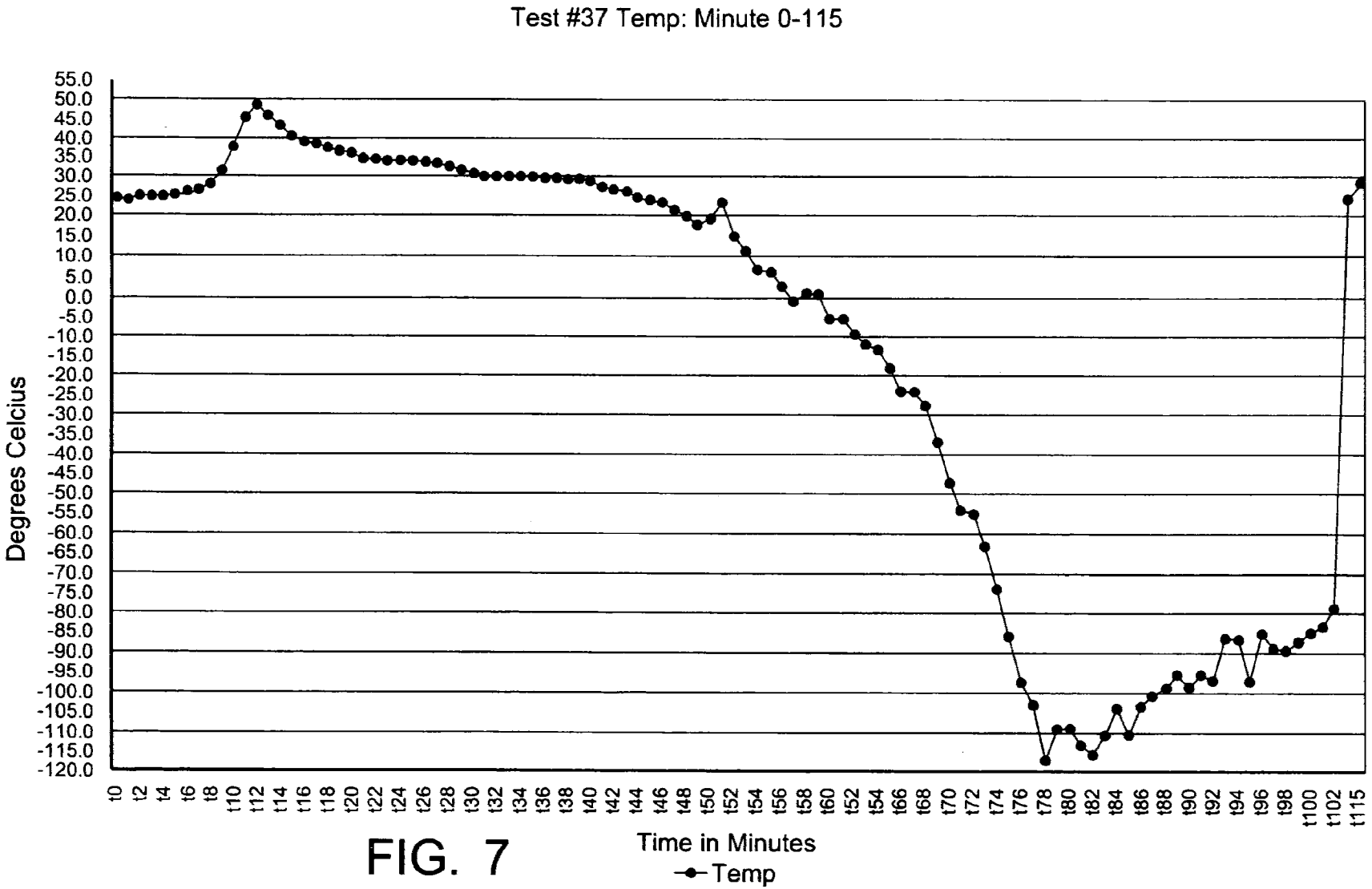

FIG. 8*b* illustrates a left side view of the vest of FIG. 8*a*, with same reference numbers referring to same elements.

The vest 30 constructed as described above includes only two layers of impact deflection panels 32, each layer being 6.35 mm thick as compared to KEVLAR vests which typically are comprised of 18 layers of impact resistant material with each layer having a thickness of 3 mm. Further, the KEVLAR vests, as with most other known bullet proof vests, includes a strike plate which adds about 25% more weight to the vest. With the present invention, a strike plate is not required to achieve superior results.

The vest 30 was tested by firing a Walther PPKS semi-automatic pistol chambered with 85 and 95-grain steel jacketed hollow point .380 caliber bullets. The pistol was pointed perpendicular to the panels 32 of the vest 30 at a distance of seven (7) meters. Upon visual inspection, no damage other than superficial scratches was found on the panels 32. No perforations of the panels 32 were found.

The above experiment was repeated with 85 and 95-grain brass solid core .380 caliber bullets, and 85 and 95 grain hollow point .380 caliber bullets, with the same results.

Further, the above experiment was repeated by using a Smith and Wesson semi-automatic pistol chambered with 22 Long Rifle and 22 Magnum bullets, with same results.

In addition, the above experiments were repeated with the above pistols positioned at angles of incidence in the range of 45 to 90 degrees with respect to the panels 32 of the vest 30 with same results. That is, no penetration of the panels 32 was found, and due to the deflection characteristics of the panels 32, no ascertainable damage other than superficial scratches to the panels was found to exist.

Lastly, the vest 30 was exposed unprotected, in inclement weather, twenty-four hours per day, to coastal salt air in the temperature range of zero to twenty-seven degrees Celsius, and in the humidity range of 27 to 100% over a period of three months with no discernible deterioration or debilitative chemical reaction in the panels 32.

Figure 9:
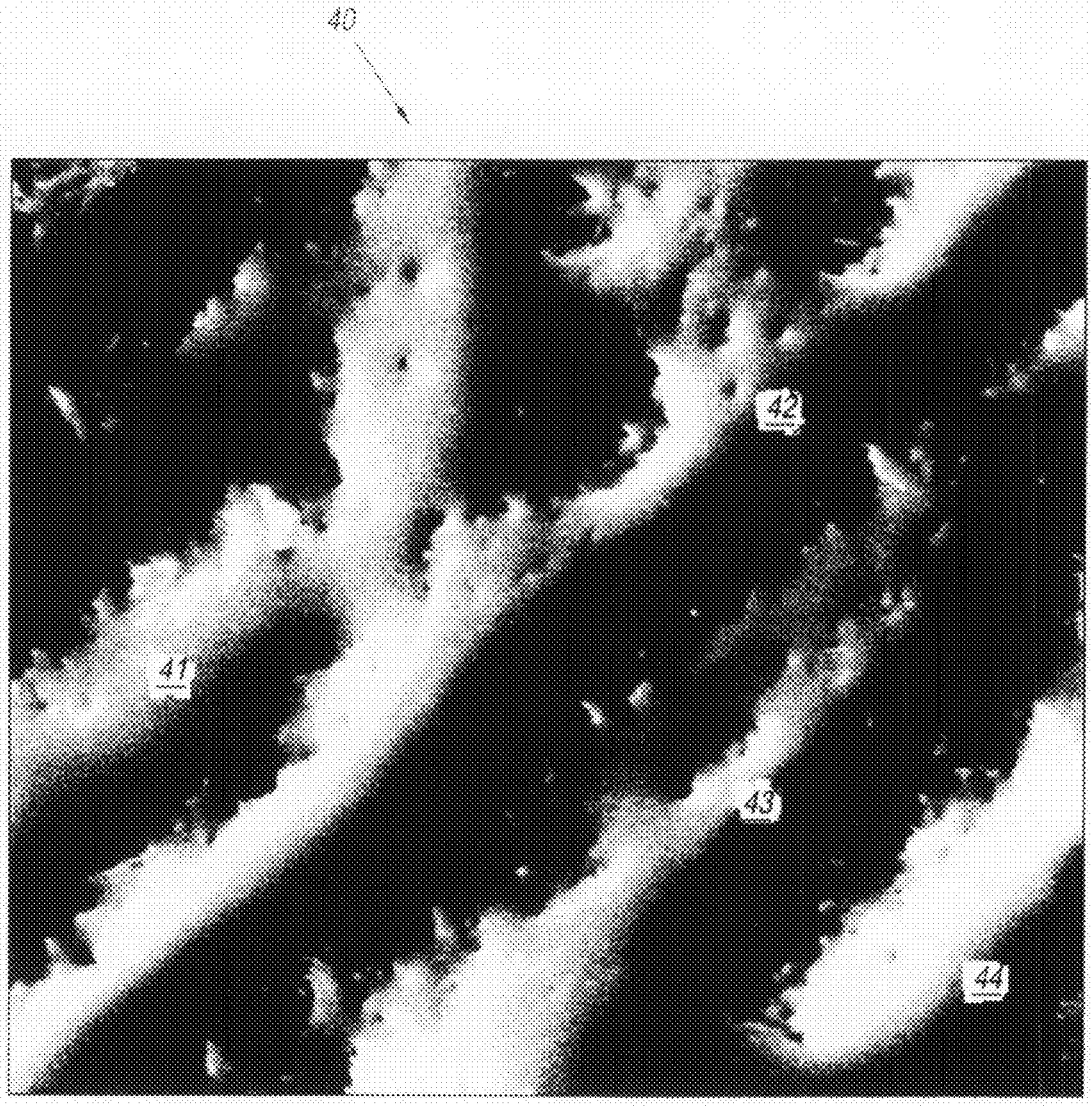
FIG. 9 is a photographic image of the structure of the circular brick 10 of FIG. 1 after being cured.

Referring to FIG. 9, a photo image 40 of a circular brick 10 of FIG. 1 is shown as it exists after being cured as described above. The photo was taken by a FEI Nova 200 NanoLab Focused Ion Beam Scanning Electron Microscope. In the photo, the image is magnified 1500 times at a distance of 30 micrometers, and shows single walled carbon nanotubes directionally aligned within an epoxy resin to form rope-like structures 41, 42, 43, and 44.

It is to be understood that while preferred embodiments of the invention have been shown and described above, variations in composition, arrangement of constituents and parts, and order of process steps may be resorted to without departing from the spirit of the invention as defined by the Claims.

What is claimed is:

1. A method of preparing impact deflecting material, which comprises:

preparing a controlled environment having a temperature range of 65 to 72° F., a relative humidity range of 30-50%, and a near DC electrical field strength of 0.0428557 volts/meter;

sprinkling single-walled carbon nanotubes (SWCNTs) uniformly onto a fiber glass cloth;

uniformly covering said SWCNTs with a composition comprising calcium carbonate, iron powder, epoxy resin, amorphous silica, non-fibrous talc, aromatic hydrocarbons, barium sulfate, alkyl phenol, mercaptan terminated polymer, and [2,4,6 dimethylamino methyl] phenol 1;

blending said SWCNTs and said composition to achieve uniform color and depth; and curing a blending of said SWCNTs and said composition in said controlled environment.

2. A method of preparing impact deflecting material, which comprises:

preparing a controlled environment having a temperature in a range between 65 and 72° F., a relative humidity in a range between 30 and 50%, and an effective near DC electrical field strength;

sprinkling SWCNTs uniformly onto a fiber glass cloth;

uniformly covering said SWCNTs with a composition comprising calcium carbonate, iron powder, epoxy resin, amorphous silica, non-fibrous talc, aromatic hydrocarbons, barium sulfate, alkyl phenol, mercaptan terminated polymer, and [2,4,6 dimethylamino methyl] phenol 1;

blending said SWCNTs and said composition to achieve uniform color and depth; and curing a blending of said SWCNTs and said composition in said controlled environment, where the effective near DC electric field strength is sufficient to directionally align the SWCNTs in said composition prior to curing.

* * * * *